US005971526A

United States Patent [19]

Klockar

[11] Patent Number: 5,971,526

[45] Date of Patent: Oct. 26, 1999

[54] METHOD AND APPARATUS FOR REDUCING CROSS COUPLING AND DOT DEFLECTION IN AN IMAGE RECORDING APPARATUS

[75] Inventor: Per Klockar, Göteborg, Sweden

[73] Assignee: Array Printers AB, Vastra Frolunda, Sweden

[21] Appl. No.: 08/635,069

[22] Filed: Apr. 19, 1996

[51] Int. Cl.[6] ..... B41J 2/06

[52] U.S. Cl. ..... 347/55

[58] Field of Search ..... 347/240, 12, 13, 347/55, 145, 128

[56] References Cited

U.S. PATENT DOCUMENTS

| | | | |
|---|---|---|---|
| 3,566,786 | 3/1971 | Kaufer et al. | 346/74.2 X |
| 3,689,935 | 9/1972 | Pressman et al. | 347/55 |
| 3,779,166 | 12/1973 | Pressman et al. | 347/124 |
| 3,815,145 | 6/1974 | Tisch et al. . | |
| 4,263,601 | 4/1981 | Nishimura et al. . | |
| 4,274,100 | 6/1981 | Pond | 347/74 |
| 4,353,080 | 10/1982 | Cross | 347/143 |
| 4,382,263 | 5/1983 | Fischbeck et al. . | |
| 4,384,296 | 5/1983 | Torpey | 347/77 |
| 4,386,358 | 5/1983 | Fischbeck . | |
| 4,470,056 | 9/1984 | Galetto et al. | 347/145 |
| 4,478,510 | 10/1984 | Fujii et al. | 347/55 |
| 4,491,794 | 1/1985 | Daley et al. . | |
| 4,491,855 | 1/1985 | Fujii et al. . | |
| 4,498,090 | 2/1985 | Honda et al. | 347/128 |
| 4,511,907 | 4/1985 | Fukuchi . | |
| 4,525,727 | 6/1985 | Kohashi et al. . | |
| 4,571,601 | 2/1986 | Teshima . | |

(List continued on next page.)

FOREIGN PATENT DOCUMENTS

| | | |
|---|---|---|
| 0345 024 A2 | 6/1989 | European Pat. Off. . |
| 0352 997 A2 | 1/1990 | European Pat. Off. . |
| 0377 208 A2 | 7/1990 | European Pat. Off. . |
| 0389 229 | 9/1990 | European Pat. Off. . |

(List continued on next page.)

OTHER PUBLICATIONS

Bassous, E. et al., "The Fabrication of High Precision Nozzles by the Anisotropic Etching of (100) Silicon", *J. Electrochem. Soc.: Solid–State Science and Technology*, vol. 125, No. 8, Aug. 1978, pp. 1321–1327.

Johnson, Jerome, "An Etched Circuit Aperture Array for TonerJet® Printing", *IS&T's Tenth International Congress on Advances in Non–Impact Printing Technologies*, 1994, pp. 311–313.

Brochure of Toner Jet® by Array Printers, *The Best of Both Worlds*, 1990.

TonerJet by Array Printers, "The Best of Both Worlds", 1990.

*Primary Examiner*—Benjamin R. Fuller
*Assistant Examiner*—C. Dickens
*Attorney, Agent, or Firm*—Knobbe, Martens, Olson & Bear, LLP

[57] ABSTRACT

The present invention refers to a direct printing method in which charged particles are transported from a particle source and deposited in an image configuration onto an information carrier. Printing is achieved in subsequent print periods by consecutively connecting variable voltage sources to complementary subsets of electrodes while supplying screen voltages to the electrodes of the remaining subset(s) to prevent interaction between adjacent electrostatic fields.

24 Claims, 9 Drawing Sheets

U.S. PATENT DOCUMENTS

| | | | |
|---|---|---|---|
| 4,675,703 | 6/1987 | Fotland . | |
| 4,717,926 | 1/1988 | Hotomi . | |
| 4,743,926 | 5/1988 | Schmidlin et al. . | |
| 4,748,453 | 5/1988 | Lin et al. . | |
| 4,814,796 | 3/1989 | Schmidlin | 347/55 |
| 4,831,394 | 5/1989 | Ochiai et al. | 347/55 |
| 4,860,036 | 8/1989 | Schmidlin | 347/55 |
| 4,903,050 | 2/1990 | Schmidlin . | |
| 4,912,489 | 3/1990 | Schmidlin . | |
| 5,028,812 | 7/1991 | Bartky | 347/12 X |
| 5,036,341 | 7/1991 | Larrson | 347/55 |
| 5,038,159 | 8/1991 | Schmidlin et al. | 347/55 |
| 5,057,855 | 10/1991 | Damouth | 347/57 |
| 5,072,235 | 12/1991 | Slowik et al. | 347/19 |
| 5,083,137 | 1/1992 | Badyal et al. | 347/14 |
| 5,095,322 | 3/1992 | Fletcher . | |
| 5,121,144 | 6/1992 | Larson et al. | 347/55 |
| 5,128,695 | 7/1992 | Maeda . | |
| 5,148,595 | 9/1992 | Doggett et al. | 347/148 X |
| 5,170,185 | 12/1992 | Takemura et al. | 347/55 |
| 5,181,050 | 1/1993 | Bibl et al. | 347/148 |
| 5,204,696 | 4/1993 | Schmidlin et al. | 347/55 |
| 5,204,697 | 4/1993 | Schmidlin . | |
| 5,214,451 | 5/1993 | Schmidlin et al. | 347/55 |
| 5,229,794 | 7/1993 | Honma et al. . | |
| 5,235,354 | 8/1993 | Larson . | |
| 5,237,346 | 8/1993 | Da Costa et al. | 347/148 |
| 5,256,246 | 10/1993 | Kitamura | 156/643 |
| 5,257,045 | 10/1993 | Bergen et al. | 347/123 |
| 5,270,729 | 12/1993 | Stearns | 347/128 |
| 5,274,401 | 12/1993 | Doggett et al. | 347/148 |
| 5,307,092 | 4/1994 | Larson | 347/55 |
| 5,329,307 | 7/1994 | Takemura et al. . | |
| 5,374,949 | 12/1994 | Wada et al. . | |
| 5,386,225 | 1/1995 | Shibata . | |
| 5,402,158 | 3/1995 | Larson | 347/55 |
| 5,414,500 | 5/1995 | Furukawa . | |
| 5,446,478 | 8/1995 | Larson . | |
| 5,450,115 | 9/1995 | Bergen et al. | 347/123 |
| 5,453,768 | 9/1995 | Schmidlin . | |
| 5,473,352 | 12/1995 | Ishida | 347/55 |
| 5,477,246 | 12/1995 | Hirabayashi et al. | 347/12 |
| 5,477,250 | 12/1995 | Larson . | |
| 5,506,666 | 4/1996 | Masuda et al. . | |
| 5,508,723 | 4/1996 | Maeda . | |
| 5,515,084 | 5/1996 | Larson | 347/55 |
| 5,526,029 | 6/1996 | Larson et al. . | |
| 5,558,969 | 9/1996 | Uyttendaele et al. . | |
| 5,559,586 | 9/1996 | Wada . | |
| 5,600,355 | 2/1997 | Wada . | |
| 5,614,932 | 3/1997 | Kagayama . | |
| 5,617,129 | 4/1997 | Chizuk, Jr. et al. | 347/123 |
| 5,625,392 | 4/1997 | Maeda | 347/55 |
| 5,640,185 | 6/1997 | Kagayama | 347/55 |
| 5,650,809 | 7/1997 | Kitamura | 347/55 |
| 5,666,147 | 9/1997 | Larson | 347/112 |
| 5,677,717 | 10/1997 | Ohashi . | |
| 5,708,464 | 1/1998 | Desie . | |
| 5,774,159 | 6/1998 | Larson . | |
| 5,805,185 | 9/1998 | Kondo . | |
| 5,818,480 | 10/1998 | Bern et al. . | |
| 5,818,490 | 10/1998 | Larson . | |
| 5,847,733 | 12/1998 | Bern . | |

FOREIGN PATENT DOCUMENTS

| | | | |
|---|---|---|---|
| 0660 201 A2 | 6/1995 | European Pat. Off. . | |
| 072 072 A2 | 7/1996 | European Pat. Off. . | |
| 0 743 572 A1 | 11/1996 | European Pat. Off. . | |
| 0752 317 A1 | 1/1997 | European Pat. Off. . | |
| 0764 540 A2 | 3/1997 | European Pat. Off. . | |
| 55-55878 | 4/1980 | Japan | 347/55 |
| 55-84671 | 6/1980 | Japan . | |
| 55-87563 | 7/1980 | Japan | 347/55 |
| 56-89576 | 7/1981 | Japan . | |
| 58-044457 | 3/1983 | Japan . | |
| 58-155967 | 9/1983 | Japan . | |
| 62-248662 | 10/1987 | Japan . | |
| 62-13356 | 11/1987 | Japan | 347/55 |
| 01120354 | 5/1989 | Japan . | |
| 05220963 | 8/1990 | Japan . | |
| 04189554 | 8/1992 | Japan . | |
| 4-268591 | 9/1992 | Japan . | |
| 4282265 | 10/1992 | Japan . | |
| 5208518 | 8/1993 | Japan . | |
| 9048151 | 2/1997 | Japan . | |
| 09118036 | 5/1997 | Japan . | |
| 2108432 | 5/1983 | United Kingdom . | |
| 9014960 | 12/1990 | WIPO . | |
| 9201565 | 2/1992 | WIPO . | |

METHOD AND APPARATUS FOR REDUCING CROSS COUPLING AND DOT DEFLECTION IN AN IMAGE RECORDING APPARATUS

FIELD OF THE INVENTION

The present invention relates to image recording methods and devices and, more particularly, to a method for improving the print quality of direct printing devices, in which a visible image pattern is formed by conveying charged toner particles from a toner carrier through a control array directly onto an information carrier.

BACKGROUND OF THE INVENTION

The most familiar and widely utilized electrostatic printing technique is that of xerography wherein latent electrostatic images formed on a charge retentive surface, such as a roller, are developed by suitable toner material to render the images visible, the images being subsequently transferred to an information carrier. This process is called an indirect process because it first forms a visible image on an intermediate surface and then transfers that image to an information carrier.

Another method of electrostatic printing is one that has come to be known as direct electrostatic printing. This method differs from the aforementioned xerographic method in that charged pigment particles (in the following called toner) are deposited directly onto an information carrier to form a visible image. In general, this method includes the use of electrostatic fields controlled by addressable electrodes for allowing passage of toner particles through selected apertures in a printhead structure. A separate electrostatic field is provided to attract the toner particles to an information carrier in image configuration. The novel feature of direct electrostatic printing is its simplicity of simultaneous field imaging and particle transport to produce a visible image on the information carrier directly from computer generated signals, without the need for those signals to be intermediately converted to another form of energy such as light energy, as is required in electrophotographic printers, e.g., laser printers.

U.S. Pat. No. 5,036,341, granted to Larson, discloses a direct printing method which begins with a stream of electronic signals defining the image information. A uniform electric field is created between a high potential on a back electrode and a low potential on a toner carrier. That uniform field is modified by potentials on selectable wires in a two dimensional wire mesh array placed in the print zone. The wire mesh array consists of parallel control wires, each of which is connected to an individual voltage source, across the width of the information carrier. The multiple wire electrodes, called print electrodes, are aligned in adjacent pairs parallel to the motion of the information carrier; the orthogonal wires, called transverse electrodes are aligned perpendicular to the motion of the information carrier. All wires are initially at a white potential $V_W$ preventing all toner transport from the toner carrier. As image locations on the information carrier pass beneath wire intersections, adjacent transverse and print wire pairs are set to a black potential $V_b$ to produce an electrostatic field drawing the toner particles from the toner carrier. The toner particles are pulled through the apertures formed in the square region among four crossed wires (i.e., two adjacent rows and two adjacent columns), and deposited on the information carrier in the desired visible image pattern. The toner particle image is then made permanent by heat and pressure fusing the toner particles to the surface of the information carrier. A drawback in the method of U.S. Pat. No. 5,036,341 is that during operation of the control electrode matrix, the individual wires can be sensitive to the opening or closing of adjacent apertures, resulting in undesired printing due to the thin wire border between apertures. That defect is called cross-coupling.

U.S. Pat. No. 5,121,144 discloses a control electrode array formed on an electrically insulating substrate with a plurality of apertures arranged therethrough, one ring-shaped electrode surrounding each of those apertures and one connector joining each ring-shaped electrode to its associated control voltage source. The apertures and associated ring electrodes are arranged in parallel rows and columns on the insulating substrate. The rows extend transversely across the width of the array, i.e., perpendicular to the motion of the information carrier. The columns are aligned at a slight angle to the motion of the information carrier in a configuration that allows printing to be achieved in sequence through each transverse row of apertures as the required dot positions arrive under the appropriate passage, thereby also allowing a larger number of dots to be deposited in a transversal direction on the information carrier. This results in a substantially enhanced printing performance, and a considerably reduced cross-coupling, since every aperture is not surrounded by any other control electrode than the intended.

However, since the apertures and their associated ring electrodes are arranged in parallel rows, the connectors leading to a ring electrode of one particular row may intersect one or more other rows. Thus, several connectors might be arranged in the relatively narrow space between two adjacent apertures of a row.

For instance, as four parallel rows of ring electrodes, each of which being individually connected to a control voltage sources, are aligned on the array, the connectors leading to the fourth row necessarily pass through the first, second and third rows. Similarly, the connectors leading to the third row extend through the first and second rows and the connectors leading to the second row extend through the first row. Consequently, three connectors extend on each side of every aperture of the first row, two connectors extend on each side of every aperture of the second row, and one connector extends on each side of every aperture of the third row. Since the distance between two adjacent apertures of a same row is typically less than one millimeter, the connectors extending between two adjacent apertures may substantially influence the field configuration about those apertures. For instance, when black voltages $V_b$ are simultaneously applied to "open" a first aperture located on one row and a second aperture located on another row, if the connector leading to the ring electrode of said second aperture borders on said first aperture, it has been observed that the toner particles attracted through that first aperture tend to be slightly deflected from their initial trajectory, due to their interaction with the electric field generated by the bordering connector. As a result, the dots addressed through said first aperture are slightly displaced with respect to the central axis of that aperture. This defect is known as the dot deflection phenomenon. Thus, to improve the print quality of direct electrographical printing devices, it is essential to reduce cross coupling and uncontrolled dot deflection. Accordingly, there is still a need for a method to reduce undesired interaction between adjacent electric fields on the array.

SUMMARY OF THE INVENTION

The present invention satisfies a need for higher quality direct printing method and direct printing devices, in which the effects of cross coupling and uncontrolled dot deflection are eliminated.

According to the present invention, a pattern of electrodes is divided up among at least two complementary subsets of electrodes, so that the whole pattern can be recomposed by superposing the different subsets. A stream of electronic signals, defining the image information, is consecutively supplied to the subsets in a predetermined order. As a particular subset is active, i.e., connected to the image information, all remaining subsets are connected to a screen potential to electrostatically shield the active subset from undesired interaction with adjacent fields. Hence, the whole image information is transmitted consecutively in a succession of print sequences, each of which corresponds to a specific subset of electrodes. The subsets are arranged so that two adjacent electrodes are comprised in different subsets. Hereby, a consecutive use of complementary subsets of electrodes ensures that the fields from neighboring electrodes are electrostatically shielded from each other at every moment of the print procedure, thus allowing the image information to be transmitted without being disturbed, as would be the case in simultaneous use of all electrodes.

Another important feature of the present invention is that one or more subsets of electrodes can be exclusively used as a screen subset during the whole print procedure to provide an additional shield between adjacent electrodes or between connectors associated to electrodes.

According to the present invention, two or more subsets of electrodes are subsequently used to perform a direct printing method. The method includes a succession of print steps, during each of which a stream of electronic signals defining the image information is supplied to the actual print step, while a screen voltage is supplied to every electrode of the remaining subsets during at least a period of the actual print step.

Thus, at every moment of the print procedure, the electrodes of a predetermined subset are active, while all remaining electrodes are used as an electrostatic screen, preventing undesired field interaction. During at least a period of each print step, the electrodes used as screen electrodes are given a screen potential $V_S$ to counteract the effects of interaction between the fields generated by active electrodes.

A various number of electrode subsets can be arranged in various configurations within the scope of the present invention, the following embodiments being given only as examples. In one embodiment of the present invention, an array of electrodes is provided with a plurality of apertures, preferably aligned in parallel rows. Each aperture is surrounded by a ring electrode which is comprised within one specific subset. Each subset comprises a plurality of apertures and the ring electrodes associated thereto.

Every ring electrode has a connector extending at least from the ring electrode to its associated voltage source. A ring electrode and its neighboring connectors are comprised in different subsets. For instance, two complementary subsets are formed on the array of electrodes, so that the whole array can be recomposed by superposing both subsets. A first subset comprises a number of apertures and associated ring electrodes. Every ring electrode whose connector is disposed nearest to any aperture of the first subset is comprised within the second subset. Similarly, every ring electrode whose connector is disposed nearest to any aperture of the second subset is comprised within the first subset. In that case, printing is performed in two print sequences. During a first print sequence, the first subset is active and a screen voltage $V_S$ is supplied to all electrodes comprised within the second subset. During a second print sequence, the second subset is active and a screen voltage $V_S$ is supplied to all ring electrodes comprised within the first subset.

In one embodiment of the present invention, the control array is composed of two complementary subsets of ring electrodes, each pattern including every second ring electrode.

In another embodiment of the present invention, the control array includes an even number of parallel rows of apertures extending transversely across the width of the print zone, i.e., perpendicular to the motion of the information carrier. The control array is divided up among four complementary subsets, each of which includes every second aperture of every second row.

In another embodiment of the present invention, the control array includes several parallel rows of apertures extending transversely across the width of the print zone, i.e., perpendicular to the motion of the information carrier. The rows are arranged symmetrically about a central transverse axis of the array, on each side of said axis. The control array is divided up among several subsets, each of which comprises at least one row of apertures on each side of the central axis.

For instance, four rows of apertures are arranged on each side of the central axis and each subset includes the pair of rows located at equal distances to the central axis of the array.

According to the present invention, the screen voltage $V_S$ supplied to the electrodes of the inactivated subset(s) can vary with respect to the position of the actual electrode or with respect to the field configuration in the vicinity of the actual electrode. For instance, the screen voltage applied to a particular electrode can differ, depending on whether the nearest active electrodes are given a black voltage $V_b$ or a white voltage $V_w$. The screen voltage can also differ from one row of electrodes to another to compensate the distance variation between the different rows and the surface of the toner cartridge. Although it is preferred to choose a screen voltage which act repelling on toner particles to prevent particle transport through the inactivated apertures, any suitable value of screen voltages can be contemplated within the scope of the present invention. However, it can be particularly convenient in many cases to choose a constant screen voltage having the same value as the white voltage $V_w$. The present invention is neither limited to a specific number of subsets nor to a particular configuration thereof, the foregoing embodiments being given only as examples. The object of the present invention is to eliminate cross coupling and uncontrolled dot deflection by splitting up the printing process among a succession of consecutive print steps, during each of which all active apertures are effectively shielded from each other.

DETAILED DESCRIPTION OF THE PREFERRED EMBODIMENT

Figure 1:
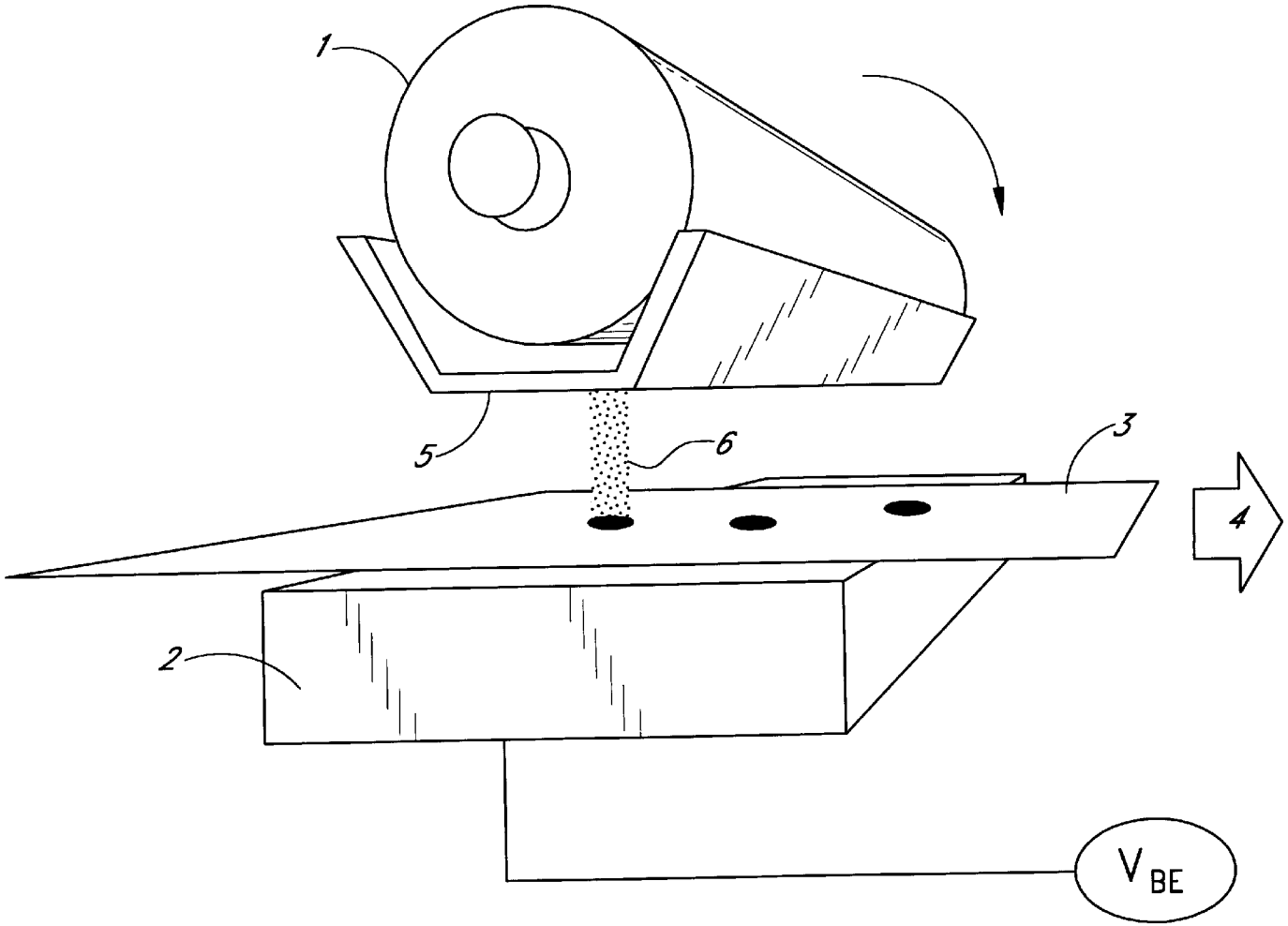
FIG. 1 is a schematic perspective view of a print zone in a direct printing device.

FIG. 1 illustrates a print zone in a device for performing a direct printing method. The print zone includes a toner or particle carrier 1, such as a rotating developer sleeve coated with a thin layer of uniformly charged toner particles, carried in a position adjacent to a back electrode 2 which is connected to a back electrode voltage source ($V_{BE}$). A uniform electric field is created between a high potential on the back electrode 2 and a low potential on the particle carrier 1 to apply attractive electric forces on the toner particles. A particle-receiving information carrier 3, such as a plain surface of untreated paper, is transferred across the print zone between the back electrode 2 and the particle carrier 1 in the direction of arrow 4. An array 5 of control electrodes, positioned between the particle carrier 1 and the information carrier 3, controls the stream of toner particles 6 transported toward the information carrier 3.

Figure 2:
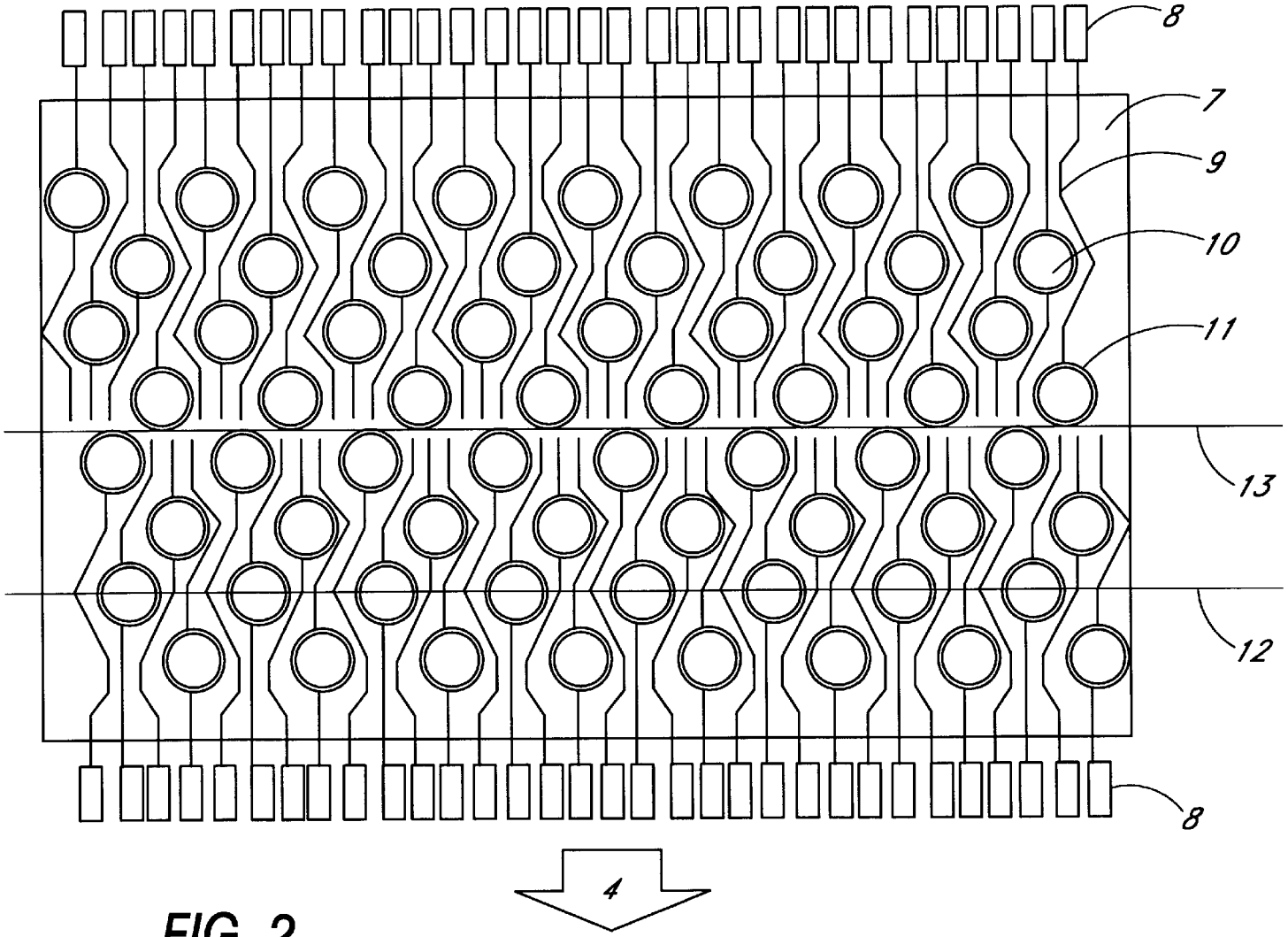
FIG. 2 is a plan view of an array of control electrodes according to a preferred embodiment of the present invention.

FIG. 2 is a schematic plan view of an array 5 of control electrodes according to a preferred embodiment of the present invention. The array 5 is formed of an electrically insulating substrate 7 having a plurality of apertures 10 arranged therethrough, each of which being surrounded by a ring electrode 11. The apertures 10 are aligned in parallel rows 12 and columns. The parallel rows 12 extend transversely across the width of the print zone in a direction perpendicular to the motion of the information carrier. The columns are aligned at a slight angle to the motion of the information carrier to ensure complete coverage of the information carrier by providing at least one addressable dot position at every point across a line in a direction transverse to the movement of the information carrier. The parallel rows 12 of apertures 10 are arranged symmetrically on each side of a central transverse axis 13 of the array, which axis 13 coincides with an orthogonal projection of the rotation axis of the particle carrier, and thus corresponds to a position nearest to the surface of the particle carrier. The control voltage sources 8 are disposed on both side of the central transverse axis 13 of the array. Each control voltage source 8 is joined to its associated ring electrode 11 through a connector 9 extending substantially parallel to the motion of the information carrier. Each connector 9 extends from a control voltage source 8 to the associated ring electrode 11 and is preferably lengthened rom that ring electrode 11 to a position adjacent to the central transverse axis 13 of the array, so that an equal number of connectors 9 extend between every pair of adjacent ring electrodes 11 of each row 12.

Figure 3:
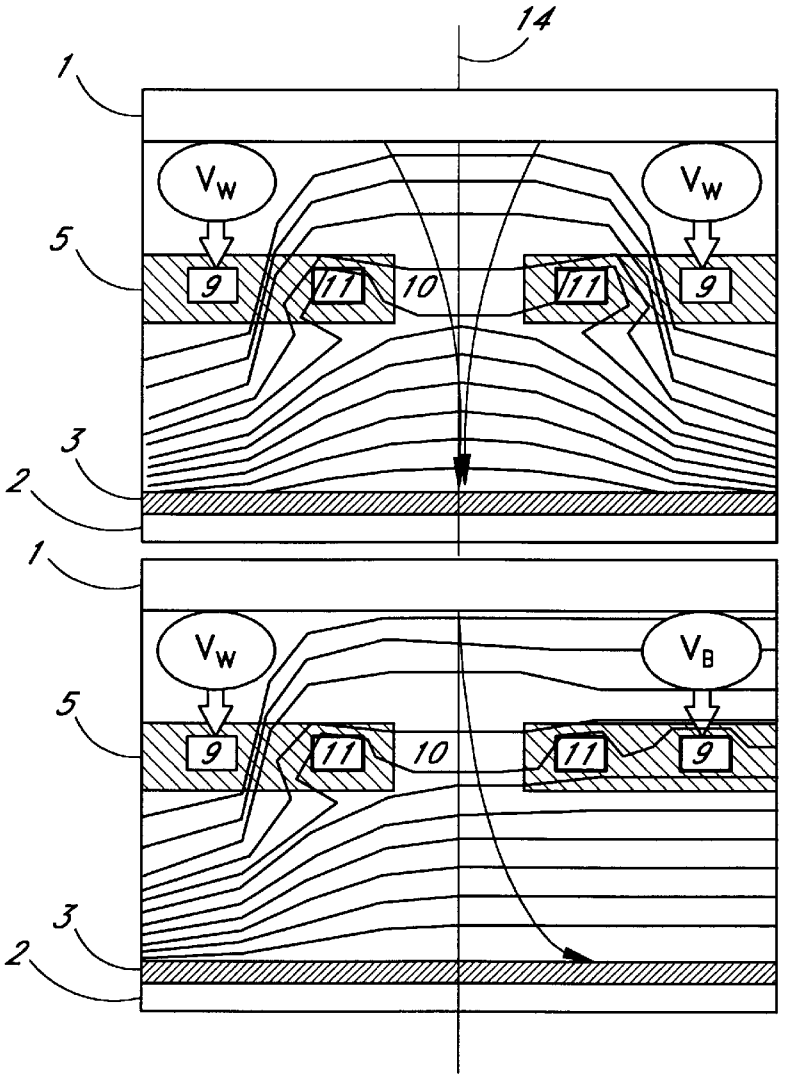
FIG. 3 illustrates the effect of uncontrolled dot deflection, which is eliminated by the present invention.

FIG. 3 illustrates schematically the effect of uncontrolled dot deflection, which is eliminated owing to the present invention. FIG. 3 is a section view of a part of the array through a row 12 of aperture 10. Toner particles are initially transported from the toner carrier (not shown) toward the information carrier 3 along a substantially straight trajectory coinciding with a central axis 14 of the aperture 10, when a white voltage, $V_w$, is applied to both connectors 9 adjacent to the electrode 11. Uncontrolled dot deflection occurs as a ring electrode 11 and a connector 9 bordering on the ring electrode 11 are simultaneously given a black voltage $V_b$, resulting in that the trajectory of transported toner particles is slightly deflected from the central axis 14 of the aperture 10. As shown in FIG. 3, the field configuration is centered about the aperture axis 14 as long as the potential symmetry is preserved and is shifted from that axis as a black voltage is applied on an adjacent connector 9.

Figure 4A:
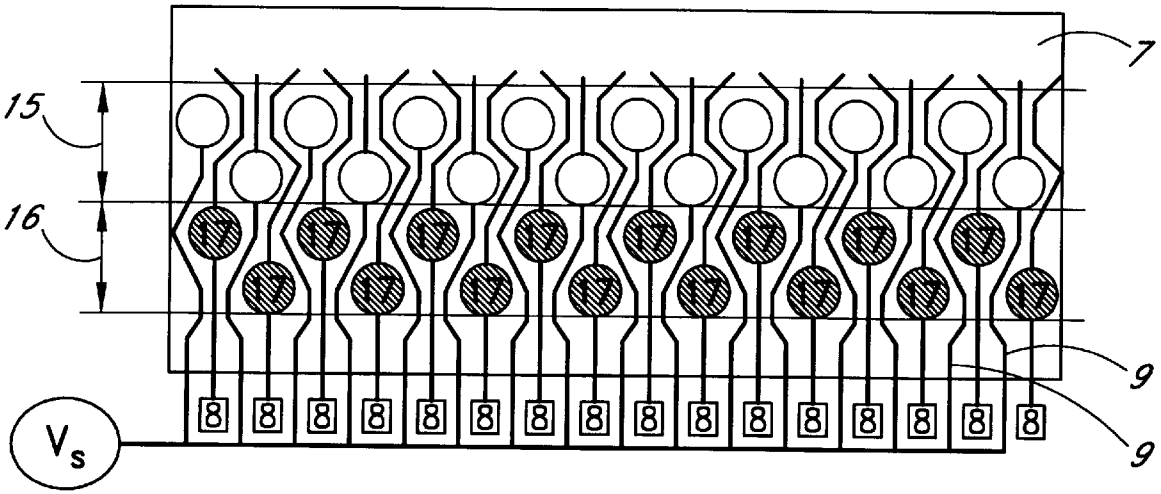
FIGS. 4*a* and 4*b* are plan views of an array of control electrodes during a first and a second print sequence, respectively.
Figure 4B:
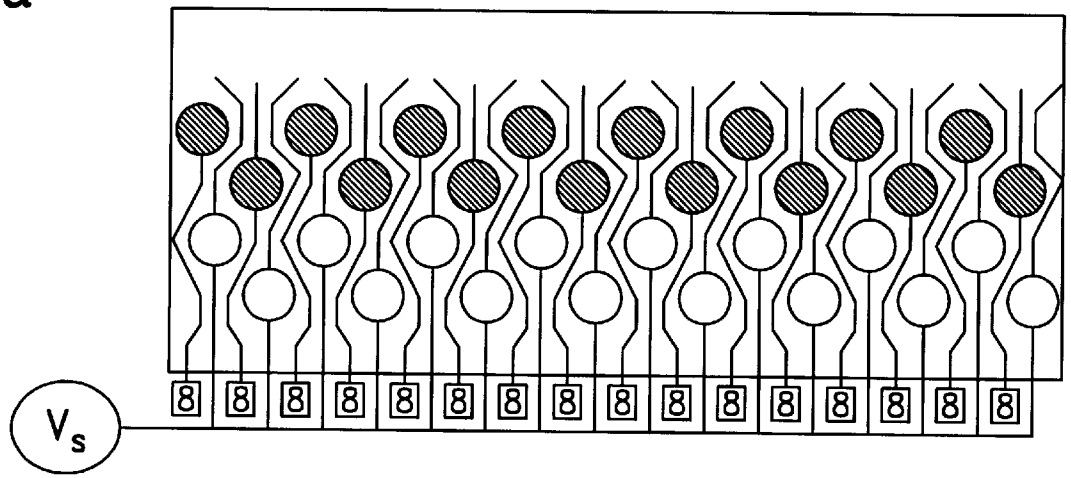
Figure 5B:
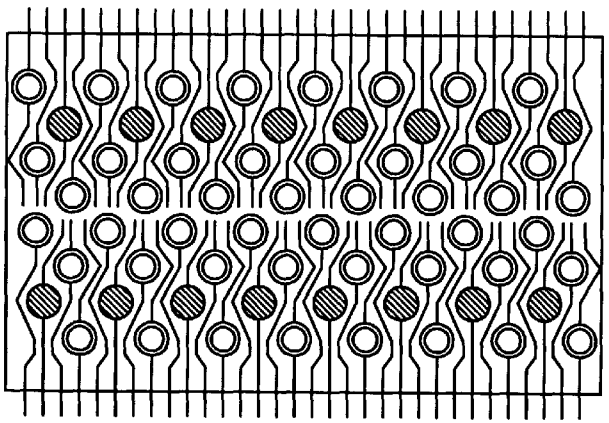
FIGS. 5*a*, 5*b*, 5*c*, and 5*d* are plan views of an array of control electrodes during four subsequent print sequences.
Figure 5D:
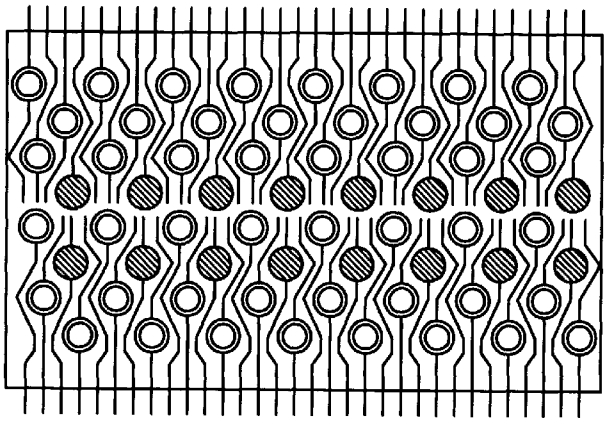
Figure 5A:
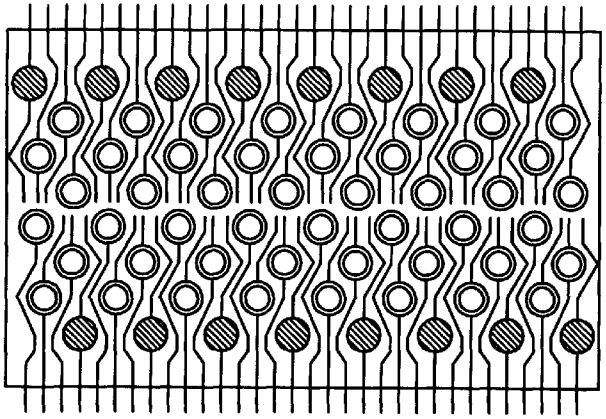
Figure 5C:
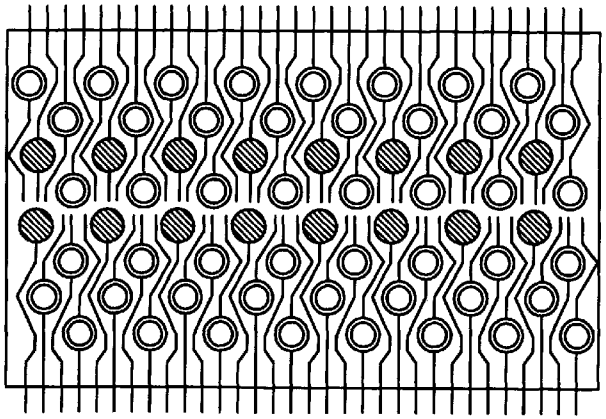

FIGS. 4*a* and 4*b* are schematic plan views of an array of control electrodes according to a first embodiment of the present invention, showing the array during a first and a second print sequence, respectively. FIG. 4*a* shows a first subset 16 of activated ring electrodes 11 (filled in black in the drawing) and a second subset 15 of ring electrodes (filled in white in the drawing). A screen voltage $V_S$, preferably equal to the white voltage $V_w$, is supplied to the second subset 15. At the same time, printing is performed using the active ring electrodes 17 of the first subset 16, which are individually connected to variable control voltage sources 8. As shown in FIG. 4*a*, every connector 9 that is disposed adjacent to an active ring electrode 17 of the first subset 16 is comprised in the second subset 15, and thus kept inactivated. Accordingly, each active ring electrode 17 is bordered by two inactivated connectors 9, whereby the field configuration about a central axis of each active aperture 10 is kept unaltered, ensuring undeflected trajectory of the transported toner particles through the opened passages.

Thereafter, a similar print step is performed using all ring electrodes of the second subset 15. That second print step is illustrated in FIG. 4*b*.

During each print step a control voltage produces an electrostatic potential on each active ring electrode 17, which, at least partially, "open" or "close" a passage through its associated aperture, thus permitting or restricting particle transport from the surface of the particle carrier 1. Accordingly, in a nonprint condition, a white voltage $V_w$ is applied to the active control electrodes 17 of the active subset to "screen" the corresponding aperture from the attractive field from the back electrode. On the contrary, in a print condition, a black voltage $V_b$ is applied to the active control electrode to "expose" the corresponding aperture to the attractive field from the back electrode, and thus extracts an appropriate amount of toner particle from the surface of the particle carrier 1. Those toner particles are thus transported through the opened aperture under influence of the attractive field from the back electrode. However, the control voltages are not necessarily limited to either a white value $V_w$ or a black value $V_b$, but can be comprised within the range between $V_w$ and $V_b$, thereby allowing variable amount of toner particles to be transported from the surface of the particle carrier. In that case, the partially opened passages allow less toner particles to be transported than that required to form a dark dot on the information carrier. Shades of toner are thus created, resulting in gray-scale capability and enhanced control of the image reproduction.

FIGS. 5*a*, 5*b*, 5*c*, and 5*d* illustrate another embodiment of the present invention. According to that embodiment, four subsequent print steps are performed using four different subsets of control electrodes. Each subset includes one row of apertures on each side of a central axis of the array.

Figure 6:
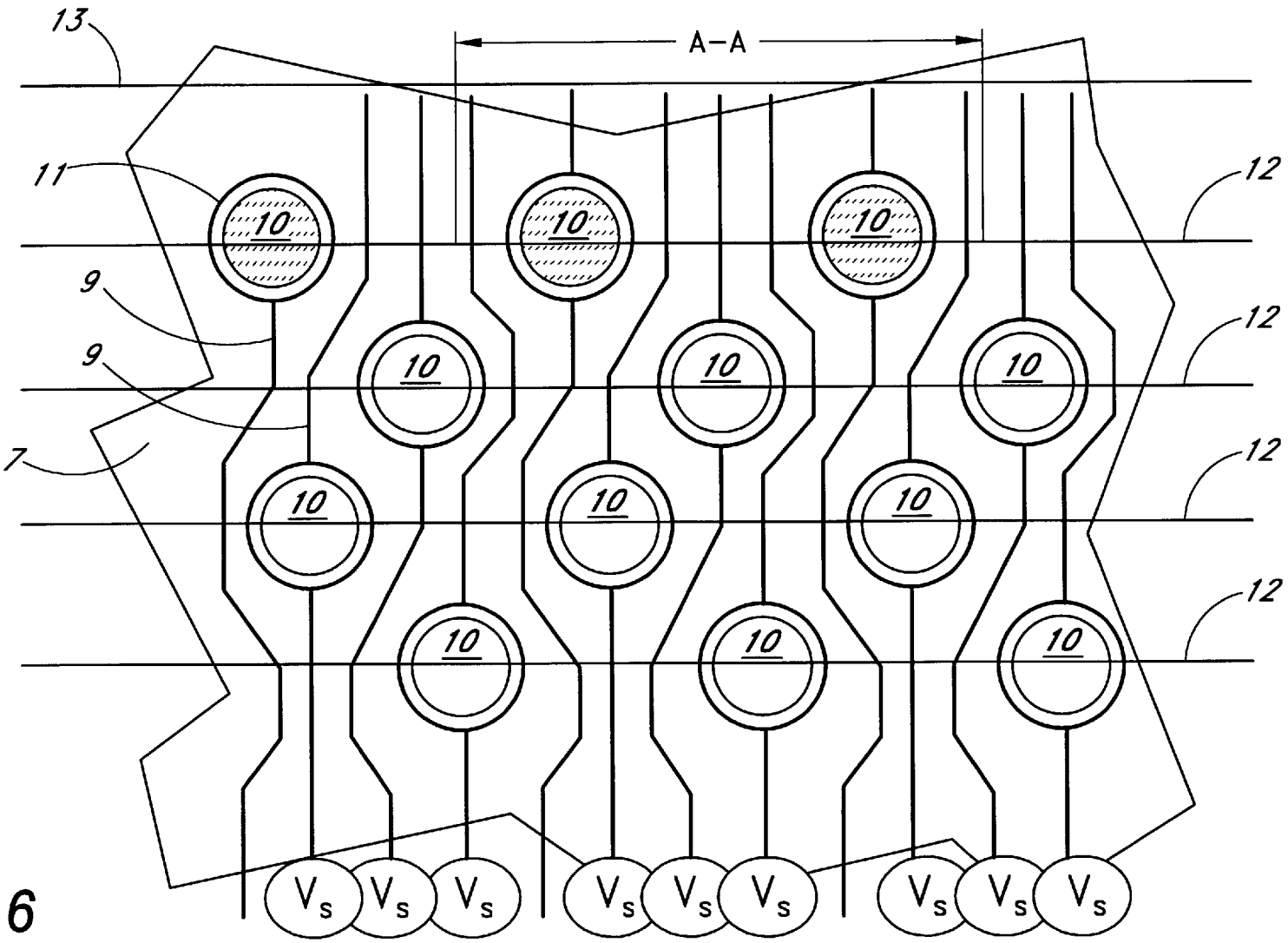
FIG. 6 is an enlargement of the a part of the array of FIG. 2.

FIG. 6 is an enlargement of a part of the array. As shown in FIG. 6, three connectors 9 are spaced between every pair of adjacent ring electrodes 11 of each row 12. As four subsequent print sequences are performed, every fourth control electrode is simultaneously activated, while the remaining electrodes and their associated connectors are given a screen voltage $V_S$. The connectors 9 extend from a voltage source 8 to a ring electrode 11 surrounding an aperture 10 and are lengthened from the ring electrode 11 to a position adjacent to the central axis 13 of the array.

Figure 7:
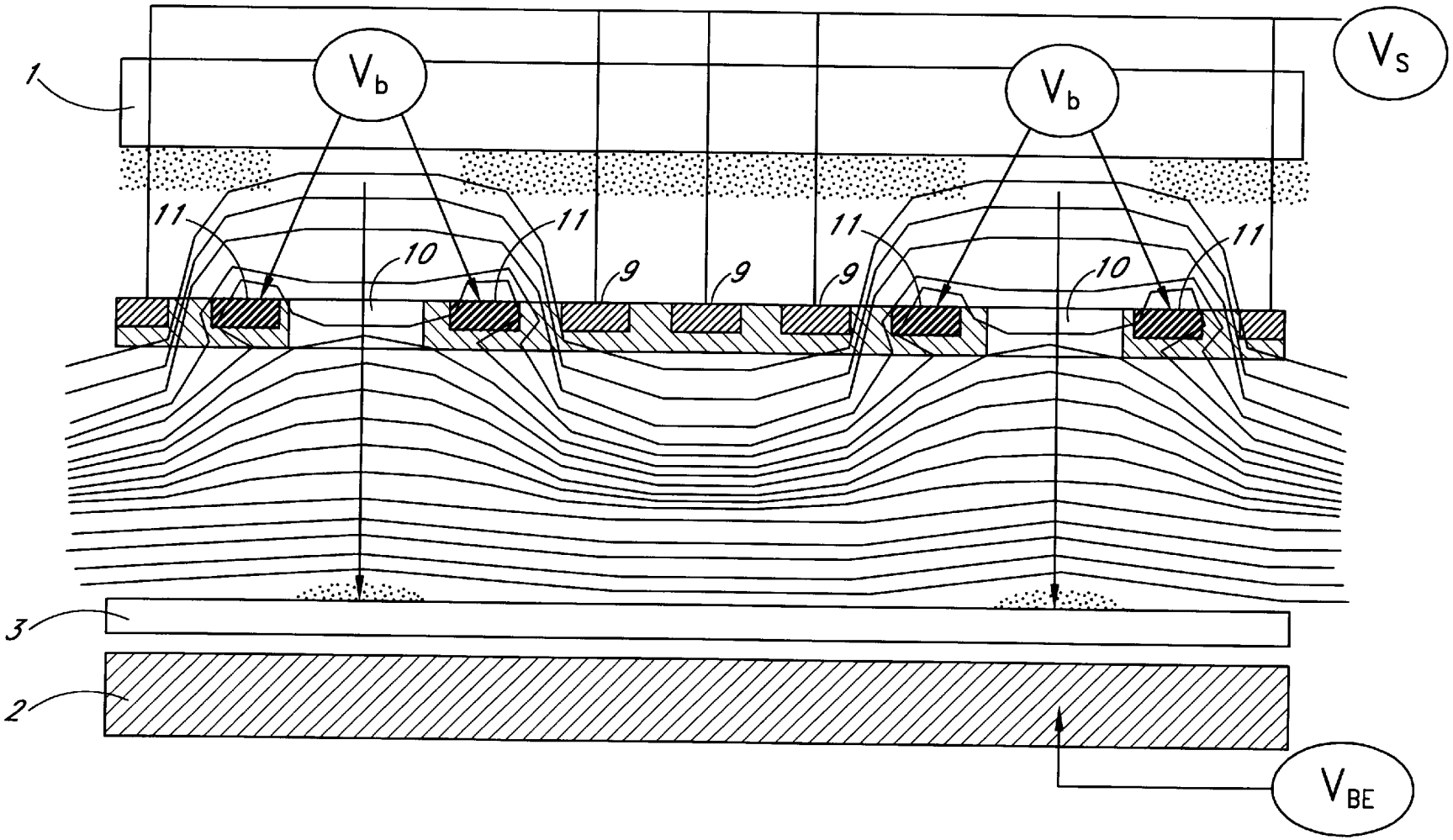
FIG. 7 is a section of FIG. 6 across the segment A—A.
Figure 8A:
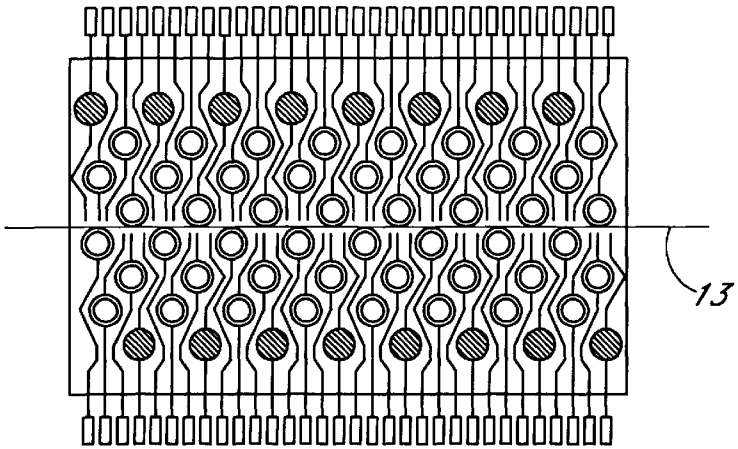
FIGS. 8*a*, 8*b*, 8*c*, and 8*d* illustrate four subsequent print sequences of a method according to an alternate embodiment of the present invention.
Figure 8B:
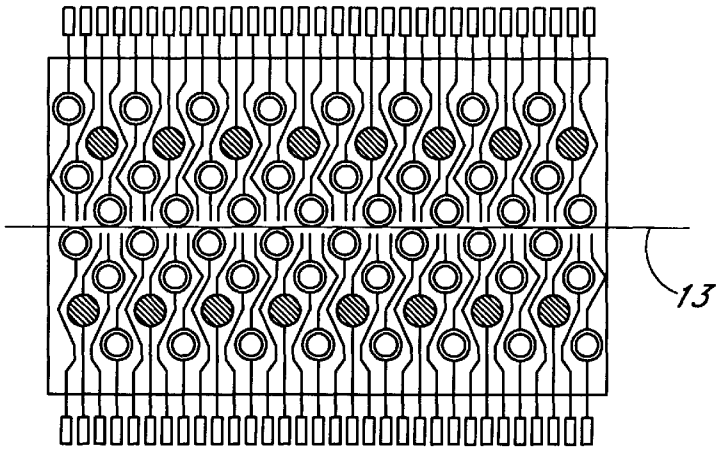
Figure 8C:
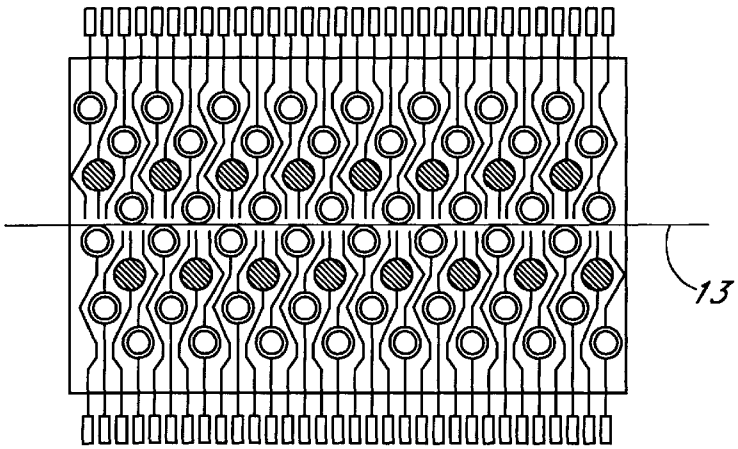
Figure 8D:
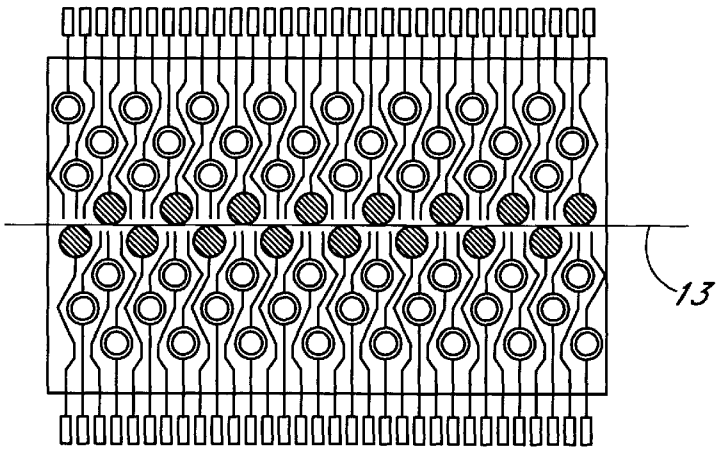
Figure 9A:
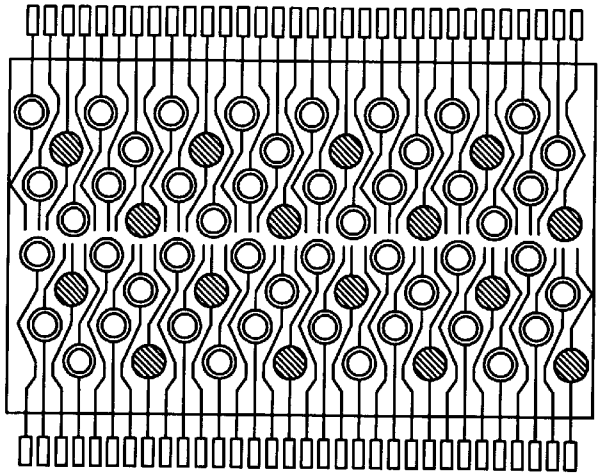
FIGS. 9*a*, 9*b*, 9*c*, and 9*d* illustrate four subsequent print sequences of a method according to an alternative embodiment of the present invention.
Figure 9B:
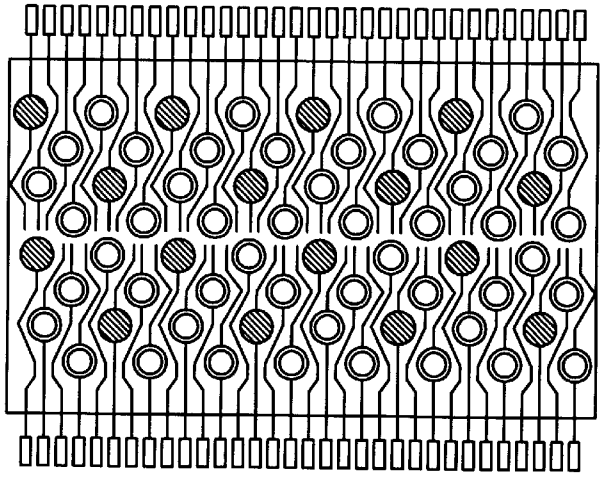
Figure 9C:
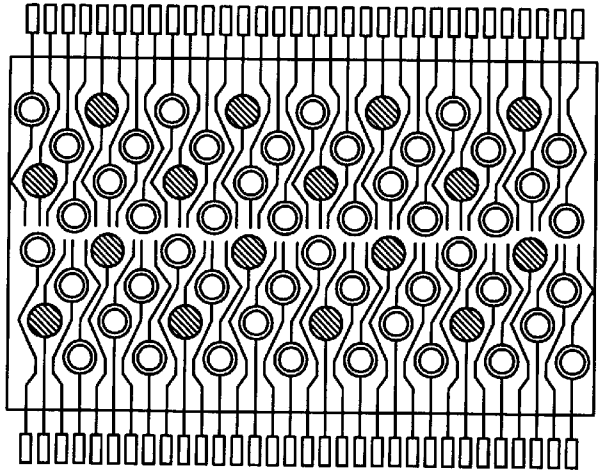
Figure 9D:
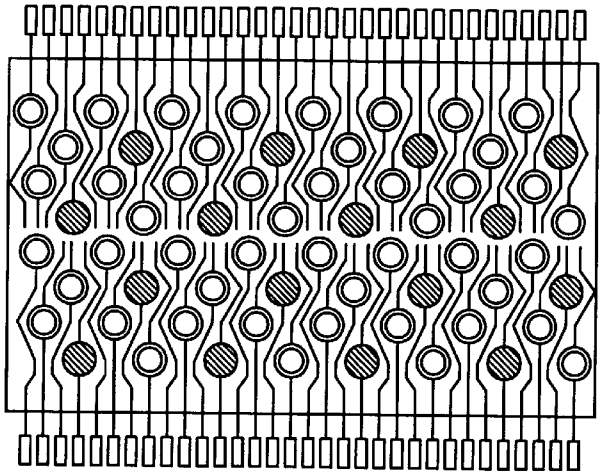

FIG. 7 is a section view of the print zone across the line A—A of FIG. 6. The print zone comprises a particle carrier 1, an array 5 of control electrodes 11 surrounding apertures 10, an information carrier 3, and a back electrode 2. Both ring electrodes 11 shown in FIG. 7 are given a print voltage $V_b$ to produce an electrostatic field that draws an amount of particles from the surface of the particle carrier 1, thus allowing those particles to be transported through the apertures 10 onto the information carrier 3 under influence of the attractive force from the back electrode 2. Simultaneously, the connectors 9 extending between both apertures 10 are set on a constant screen potential $V_S$, which generates an electrostatic field acting repelling on the toner particles located between the apertures 10 on the surface of the particle carrier 1 to prevent those particles from being influenced by the field from the "opened" apertures. For instance, if the toner particles have a negative charge, the back electrode potential $V_{BE}$ is typically of the order of +1.5 kV and the screen potential $V_S$ is preferably chosen within the range of −100V to 0V. In many embodiments of the present invention, it is convenient to choose a screen potential $V_S$ that is equal to the white potential $V_w$ used in the nonprint condition.

FIGS. 8*a*, 8*b*, 8*c*, and 8*d* illustrate four subsequent steps of a print method according to the present invention. The array of control electrodes has a transverse central axis 13 about which several parallel transverse rows of apertures are symmetrically arranged. For instance, that central axis of the array coincides with an orthogonal projection of the rotation axis of the particle carrier on the surface of the array. In FIGS. 8*a*, 8*b*, 8*c*, 8*d*, four subsets of apertures are activated in turn (filled in black). Each subset includes one row on each side of and at equal distance to the central axis 13 of the array.

Another embodiment of the method of the present invention is illustrated in FIGS. 9*a*, 9*b*, 9*c*, 9*d*, wherein the subsets comprise every second aperture of every second row.

However, the present invention is not strictly limited to the specific configurations described above, those embodiments being given only as example to illustrate and clarify the fundamental concepts of the invention. Those skilled in the art would recognize that that same result could be achieved using a various number of subsets, various configurations thereof, and various values of the screen voltage $V_S$.

What is claimed is:

1. A direct printing method in which charged particles are transported from a particle source and deposited in an image configuration onto an information carrier, comprising the steps of:

providing a back electrode;

conveying the charged particles to a particle source adjacent to the back electrode;

positioning said information carrier between the back electrode and the particle source;

creating an electric potential difference between the back electrode and the particle source to apply an attractive force on the charged particles;

providing at least a first subset and a second subset of electrodes between the particle source and the information carrier, each electrode of said first subset and said second subset of electrodes having an associated connector extending from a variable control voltage source to the electrode, wherein a plurality of said associated connectors of said first subset of electrodes extend proximate to electrodes of said second subset of electrodes;

connecting variable voltage sources to said associated connectors of said second subset of electrodes to produce electrostatic fields proximate to said electrodes of said second subset of electrodes to at least partially open passages in each electrostatic field by influencing said attractive force from the back electrode, thus permitting transportation of charged particles from the particle source towards the information carrier;

connecting said variable voltage sources to said associated connectors of said second subset of electrodes to produce electrostatic fields proximate to said electrodes of said second subset of electrodes to close passages in each electrostatic field by influencing said attractive force from the back electrode, thus restricting transportation of charged particles from the particle source toward the information carrier; and supplying a voltage from said variable voltage sources to said associated connectors of sad first subset of electrodes extending proximate to said electrodes of said second subset of electrodes to prevent interaction between said associated connectors of said first subset of electrodes and said electrostatic fields of said electrodes of said second subset of electrodes.

2. A direct printing method in which charged particles are transported from a particle source and deposited in an image configuration onto an information carrier, comprising the steps of:

providing a back electrode;

conveying the charged particles to a particle source adjacent to the back electrode;

positioning said information carrier between the back electrode and the particle source;

creating an electric potential difference between the back electrode and the particle source to apply an attractive force on the charged particles;

providing at least a first subset and a second subset of electrodes between the particle source and the information carrier, each electrode of said first subset and said second subset of electrodes having an associated connector extending from a respective variable control voltage source to the electrode, wherein a plurality of said associated connectors of said first subset of electrodes extend proximate to electrodes of said second subset of electrodes;

connecting said variable control voltage source to said associated connectors of said second subset of electrodes to produce electrostatic fields proximate to said electrodes of said second subset of electrodes to at least partially open passages in each electrostatic field by influencing said attractive force from the back electrode, thus permitting transportation of charged particles from the particle source towards the information carrier;

connecting said variable control voltage sources to said associated connectors of said second subset of electrodes to produce electrostatic fields proximate to said electrodes of said second subset of electrodes to close passages in each electrostatic field by influencing said attractive force from the back electrode, thus restricting transportation of charged particles from the particle source toward the information carrier;

supplying screen voltages from said variable control voltage source to said associated connectors of said first subset of electrodes extending proximate to said electrodes of said second subset of electrodes to prevent interaction between said associated connectors of said first subset of electrodes and said electrostatic fields of said electrodes of said second subset of electrodes; and performing at least first and second consecutive print periods, wherein:

during said first print period said electrostatic fields are produced by the electrodes of said first subset of electrodes, while said screen voltages are simultaneously supplied to the associated connectors of said second subset of electrodes to prevent interaction between said associated connectors of said second subset of electrodes and said electrostatic fields; and during said second print period said electrostatic fields are produced by the electrodes of said second subset of electrodes, while said screen voltages are simultaneously supplied to the associated connectors of said first subset of electrodes to prevent interaction between said associated connectors of said first subset of electrodes and said electrostatic fields.

3. The method of claim 1, in which the charged particles are toner.

4. The method of claim 1, in which two electrodes positioned adjacent to each other are comprised in different subsets of electrodes.

5. The method of claim 1, in which the electrodes are arranged on an electrically insulating substrate provided with a plurality of apertures arranged therethrough, each aperture being at least partially surrounded by a control electrode.

6. The method of claim 4, in which every control electrode having said associated connector extending in a vicinity of any electrode comprised in a particular subset is comprised in another subset.

7. The method of claim 1, in which the electrodes are arranged in parallel rows, each subset of electrodes comprising at least one row of electrodes.

8. The method of claim 1, in which the electrodes are arranged in parallel rows, each subset of electrodes comprising every second row of electrodes.

9. The method of claim 1, in which the electrodes are arranged in parallel rows, each subset of electrodes comprising every second electrode of every second row of electrodes.

10. The method of claim 1, in which the electrodes are arranged in two complementary subsets, each of which includes every second electrode.

11. The method of claim 1, in which the electrodes are arranged in three complementary subsets, each of which includes every third electrode.

12. The method of claim 1, in which the electrodes are arranged in four complementary subsets, each of which includes every fourth electrode.

13. The method of claim 1, in which said variable voltage sources supply voltages having values comprised within a range of $V_W$ to $V_b$, wherein:

$V_b$ corresponds to a black voltage and is chosen to cause an appropriate amount of charged particles to be deposited onto the information carrier, said amount corresponding to a dark dot on the image configuration; and $V_W$ corresponds to a white voltage and is chosen to prevent transport of charged particles from the particle source.

14. The method of claim 1, in which the screen voltages produces electric forces acting on the charged particles.

15. The method of claim 1, in which the screen voltages are chosen to prevent transport of charged particles from the particle source.

16. The method of claim 2, in which the screen voltages are applied during a part of each print period.

17. The method of claim 1, in which the screen voltages are equal to the white voltage $V_W$ used in nonprint condition.

18. The method of claim 1, in which the screen voltages are variable.

19. A direct printing apparatus comprising:

a source of charged particles;

a back electrode adjacent to said source;

a particle-receiving information carrier;

a voltage source for creating an electric potential difference between the back electrode and the particle source to apply an attractive force on the charged particles;

at least a first subset and a second subset of electrodes between the particle source and the information carrier, each electrode of said first subset and said second subset of electrodes having an associated connector extending from a control voltage source to the electrode, wherein a plurality of said associated connectors of said first subset of electrodes extend proximate to electrodes of said second subset of electrodes;

a plurality of variable voltage sources connected to said associated connectors of said second subset of electrodes to produce electrostatic fields proximate to said electrodes of said second subset of electrodes to at least partially open passages in each electrostatic field by influencing said attractive force, thus permitting transportation of charged particles from the particle source towards the information carrier, said variable voltage sources connected to said associated connectors of said second subset of electrodes to produce electrostatic fields proximate to said electrodes of said second subset of electrodes to close passages in each electrostatic field by influencing said attractive force from the back electrode, thus restricting transportation of charged particles from the particle source toward the information carrier, and screen voltages from the variable voltage sources applied to said associated connectors of said first subset of electrodes extending proximate to said electrodes of said second subset of electrodes to prevent interaction between said associated connectors of said first subset of electrodes and said electrostatic fields of said electrodes of said second subset of electrodes.

20. The method of claim 2, in which the charged particles are toner.

21. The method of claim 2, in which two electrodes positioned adjacent to each other are comprised in different subsets of electrodes.

22. The method of claim 2, in which said variable voltage sources supply voltages having values comprised within a range of $V_W$ to $V_b$, where:

$V_b$ corresponds to a black voltage and is chosen to cause an appropriate amount of charged particles to be deposited onto the information carrier, said amount corresponding to a dark dot on the image configuration; and $V_W$ corresponds to a white voltage and is chosen to prevent transport of charged particles from the particle source.

23. The method of claim 2, in which the screen voltages produce electric forces acting on the charged particles.

24. The method of claim 2, in which the screen voltages are chosen to prevent transport of charged particles from the particle source.

* * * * *

UNITED STATES PATENT AND TRADEMARK OFFICE
CERTIFICATE OF CORRECTION

PATENT NO. : 5,971,526

DATED : October 26, 1999

INVENTOR(S): Per Klockar

It is certified that error appears in the above-identified patent and that said Letters Patent is hereby corrected as shown below:

In column 5 at line 48, change "rom" to --from--.

In column 8 at line 16, change "sad" to --said--.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*